US010359716B2

(12) United States Patent
Sato

(10) Patent No.: US 10,359,716 B2
(45) Date of Patent: Jul. 23, 2019

(54) IMAGE FORMING UNIT AND IMAGE FORMING APPARATUS

(71) Applicant: Oki Data Corporation, Tokyo (JP)

(72) Inventor: Toshiharu Sato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 16/010,901

(22) Filed: Jun. 18, 2018

(65) Prior Publication Data

US 2018/0373178 A1 Dec. 27, 2018

(30) Foreign Application Priority Data

Jun. 26, 2017 (JP) ..... 2017-123819

(51) Int. Cl.
*G03G 15/08* (2006.01)

(52) U.S. Cl.
CPC . *G03G 15/0808* (2013.01); *G03G 2215/0641* (2013.01)

(58) Field of Classification Search
USPC ..... 399/252, 279, 281, 286
See application file for complete search history.

(56) References Cited

U.S. PATENT DOCUMENTS 9,046,818 B2 * 6/2015 Sato ..... G03G 15/0808

FOREIGN PATENT DOCUMENTS

JP 2005-148664 A 6/2005

* cited by examiner

*Primary Examiner* — Hoan H Tran
(74) *Attorney, Agent, or Firm* — Metrolexis Law Group, PLLC

(57) ABSTRACT

A developer supply member according to an embodiment includes: a shaft with conductivity; and a conductive foam layer that is formed on a surface of the shaft. The conductive foam layer contains silicone rubber as a main component and includes a stress decay of 25% or less and a residual strain of 100 μm or less.

17 Claims, 10 Drawing Sheets

IMAGE FORMING UNIT AND IMAGE FORMING APPARATUS

CROSS REFERENCE TO RELATED APPLICATIONS

This application claims priority based on 35 USC 119 from prior Japanese Patent Application No. JP2017-123819 filed on Jun. 26, 2017, entitled "IMAGE FORMING UNIT AND IMAGE FORMING APPARATUS", the entire contents of which are incorporated herein by reference.

BACKGROUND

The disclosure relates to an image forming apparatus such as a printer, a copy machine, and a facsimile, and an image forming unit used for the image forming apparatus.

In an image forming apparatus using the electrophotography, an electrostatic latent image is formed on the surface of a photoconductor drum, and is developed by a developer held on the surface of a developing roller. The developer is supplied to the developing roller by a supply roller. The supply roller is a roller (such as a sponge roller) in which a conductive foam layer is formed on the surface of a shaft made of metal or the like. The supply roller is disposed to be in contact with the surface of the developing roller.

Related techniques are disclosed in, for example, Japanese Unexamined Patent Application Publication No. 2005-148664.

SUMMARY

When the conductive foam layer of the supply roller is left unoperated for a long period of time in contact with the developing roller, a depressed area may be formed in the contact portion with the developing roller. With such a depressed area formed in the conductive foam layer, when image formation is resumed, the developer is not sufficiently supplied to the developing roller at a portion corresponding to the depressed area, resulting in a problem in that a belt of an uneven image occurs.

An object of an embodiment is to reduce the occurrence of image unevenness which is caused by the conductive foam layer, and to improve image quality.

An aspect is a developer supply member that includes: a shaft with conductivity; and a conductive foam layer that is formed on a surface of the shaft. The conductive foam layer contains silicone rubber as a main component and includes a stress decay of 25% or less and a residual strain of 100 μm or less.

Another aspect is an image forming unit that includes: a developer carrier that supplies a developer to an image carrier with a surface on which a latent image is formed, and that develops the latent image; and a developer supply member disposed in contact with the developer carrier. The developer supply member includes: a shaft with conductivity; and a conductive foam layer that is formed on a surface of the shaft. The conductive foam layer contains silicone rubber as a main component and includes a stress decay of 25% or less and a residual strain of 100 μm or less.

According to the aspects, deformation of an elastic foam layer can be suppressed and image quality can be improved.

DETAILED DESCRIPTION

Figure 1:
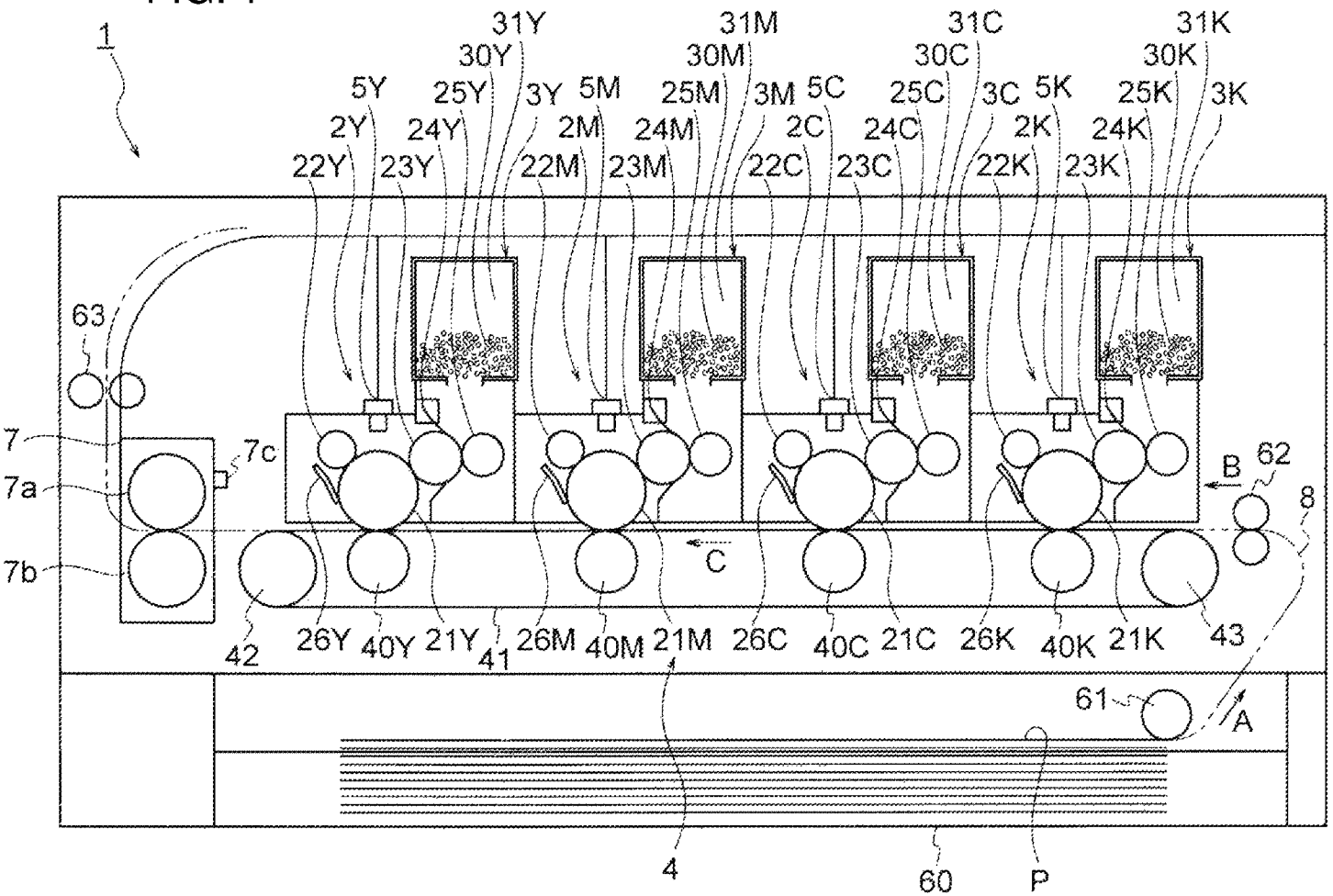
FIG. 1 is a diagram illustrating the configuration of an image forming apparatus in an embodiment.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

<Configuration of Image Forming Apparatus>

FIG. 1 is a diagram illustrating the basic configuration of an image forming apparatus 1 in one or more embodiments. The image forming apparatus 1 is configured as a color electrophotographic printer here. The image forming apparatus 1 includes image forming units 2K, 2C, 2M, and 2Y that form toner images of black (K), cyan (C), magenta (M), and yellow (Y), respectively; LED heads 5K, 5C, 5M, and 5Y that irradiate respective photoconductor drums (described below) of the image forming units 2K, 2C, 2M, and 2Y with light; a transfer unit 4 that transfers the toner images onto paper P; and a fixing unit 7 that fixes the toner images to the paper P.

The image forming apparatus 1 also includes a paper feed cassette 60 that stores the paper P (medium); a pickup roller 61 that delivers the paper P stored in the paper feed cassette 60 to a transport path 8; a transport roller pair 62 that transports the paper P delivered to the transport path 8 to the image forming units 2K, 2C, 2M, and 2Y; and a discharge roller pair 63 that discharges the paper P which has passed through the fixing unit 7.

The paper feed cassette 60 (medium storage) stores sheets of the paper P as media with the sheets stacked, and is detachably mounted in a lower portion of the image forming apparatus 1.

The pickup roller 61 feeds the sheets of the paper P stored in the paper feed cassette 60 one by one, and delivers the paper P to the transport path 8 as indicated by an arrow A. The transport roller pair 62 corrects skew of the paper P delivered to the transport path 8 by the pickup roller 61, and transports the paper P to the image forming units 2K, 2C, 2M, and 2Y as indicated by an arrow B.

The image forming units 2K, 2C, 2M, and 2Y form toner images of black, cyan, magenta, and yellow, and are arranged in a row (here, from the right to the left in FIG. 1) along the transport path 8 of the paper P. Also, the image forming units 2K, 2C, 2M, and 2Y are detachably mounted in the image forming apparatus 1.

Figure 2:
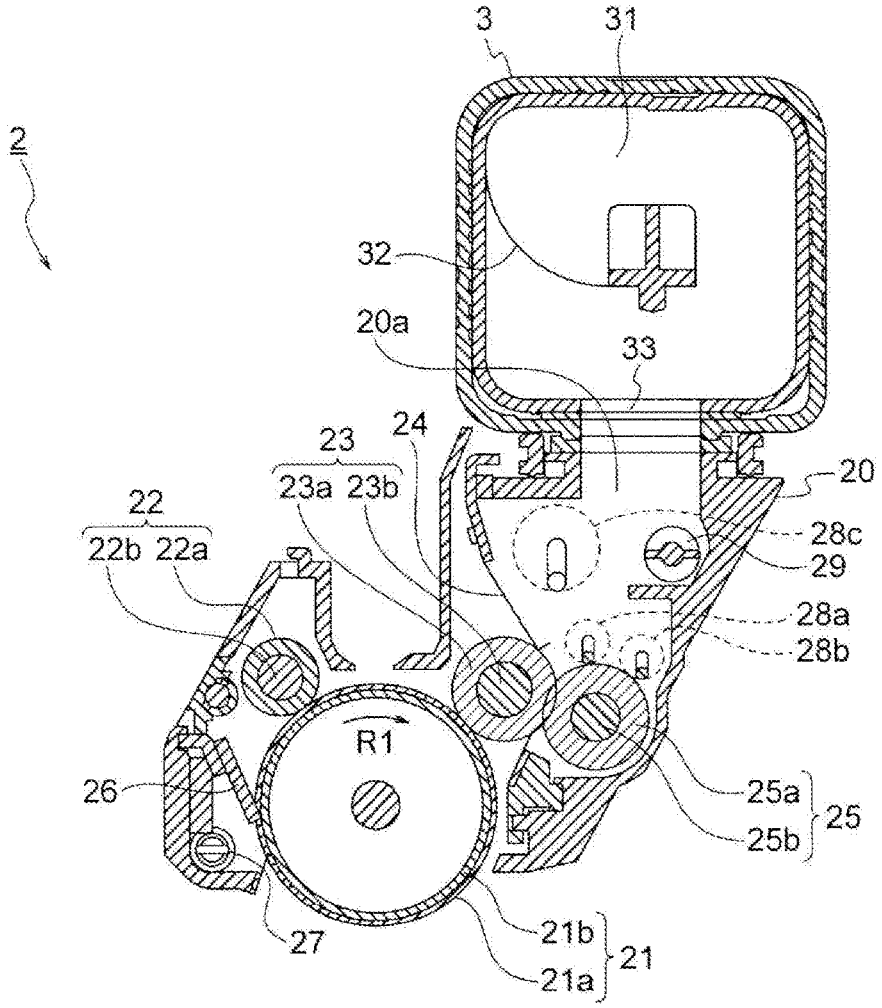
FIG. 2 is a cross-sectional view illustrating the configuration of an image forming unit in an embodiment.

FIG. 2 is a cross-sectional view illustrating the configuration of the image forming units 2. The image forming units 2K, 2C, 2M, and 2Y have a common configuration except for each toner (developer) to be used. Therefore, the image forming units 2K, 2C, 2M, and 2Y and their components will be described with the symbols K, C, M, and Y omitted.

As illustrated in FIG. 2, the image forming units 2 have respective photoconductor drums 21 as image carriers. The photoconductor drums 21 rotate in the direction indicated by an arrow R in FIG. 2. A charging roller 22 as a charging member, a developing roller 23 as a developer carrier, and a cleaning blade 26 as a cleaning member are disposed around each of the photoconductor drums 21 in a rotational direction.

Also, a supply roller 25 as a supply member, and a developing blade 24 as a layer regulation member are disposed around the developing roller 23. A toner storage chamber 20*a*, which is space for storing toner, is formed above the supply roller 25 and the developing blade 24. The axial direction of each roller of the image forming units 2 and the longitudinal direction of the developing blade 24 are parallel to the axial direction of the photoconductor drum 21.

Although stirring members 28*a*, 28*b*, and 28*c* that stir toner, and a transport screw 29 for uniformly leveling the toner in the axial direction are disposed in the toner storage chamber 20*a*, a description of these is omitted.

A toner cartridge 3 (developer storage body) for supplying toner is mounted in each image forming unit 2. The toner cartridge 3 is detachably mounted, for instance, in an upper portion of the body of the image forming unit 2.

The toner cartridge 3 has a toner storage 31 that stores toner, and has a stirring bar 32 that stirs toner, inside the toner storage 31. Also, a toner supply port 33 for supplying toner to the toner storage chamber 20*a* of the image forming unit 2 is formed at the bottom of the toner cartridge 3.

The photoconductor drum 21 has a cylindrical conductive support 21*b*, and a photoconductive layer 21*a* formed on the surface of the conductive support 21*b*. The conductive support 21*b* is made of, for instance, a metal pipe such as an aluminum pipe. The photoconductive layer 21*a* includes a laminated body of a charge generation layer and a charge transport layer. A blocking layer (intermediate layer) may be provided between the conductive support 21*b* and the photoconductive layer 21*a*.

The charging roller 22 is provided so as to be in contact with the surface of the photoconductor drum 21, and follows the rotation of the photoconductor drum 21 and rotates. The charging roller 22 has, for instance, a shaft 22*b* made of metal, and an elastic layer 22*a* formed on the surface of the shaft 22*b*. The elastic layer 22*a* is a semiconductive rubber layer made of, for instance, semiconductive epichlorohydrin rubber.

The developing roller 23 is disposed so as to be in contact with the surface of the photoconductor drum 21. Also, the developing roller 23 rotates in the direction opposite to the rotational direction of the photoconductor drum 21 (in other words, in the same direction of movement at the contact portion on the surface) at a predetermined circumferential speed ratio. The developing roller 23 has, for instance, a shaft 23*b* made of metal such as stainless steel, and an elastic layer 23*a* formed on the surface of the shaft 23*b*. The elastic layer 23*a* is made of, for instance, semiconductive urethane rubber. A surface treatment layer may be provided on the surface of the elastic layer 23*a*.

The developing blade 24 is a metal plate-shaped member having substantially the same length as the axial length of the elastic layer 23*a* of the developing roller 23. The thickness of the developing blade 24 is, for instance, 0.08 mm. The developing blade 24 has one end fixed to a frame 20 of the image forming unit 2 and a bent portion formed on the other end side in pressure contact with the surface of the developing roller 23. The developing blade 24 regulates the thickness of a toner layer formed on the surface of the developing roller 23.

The supply roller 25 is disposed so as to be in contact with the surface of the developing roller 23. Also, the supply roller 25 rotates in the same direction as the rotational direction of the developing roller 23 (in other words, in the direction opposite to the direction of movement at the contact portion on the surface) at a predetermined circumferential speed ratio. The supply roller 25 has a shaft 25*b* made of, for instance, metal, and a conductive foam layer 25*a* (silicone sponge layer) provided on the surface of the shaft 25*b*.

The cleaning blade 26 is made of, for instance, urethane rubber, and is disposed so as to be in contact with the surface of the photoconductor drum 21. The cleaning blade 26 scrapes off and removes residual toner remaining on the surface of the photoconductor drum 21. Below the cleaning blade 26, a transport member 27 is disposed, which transports the toner (waste toner) scraped off by the cleaning blade 26 in the axial direction of the photoconductor drum 21. A description of transport of the waste toner is omitted.

Returns to FIG. 1, the LED heads 5K, 5C, 5M, and 5Y are disposed above and opposed to the photoconductor drums 21K, 21C, 21M, and 21Y of the image forming units 2K, 2C, 2M, and 2Y. The LED heads 5K, 5C, 5M, and 5Y each have a light emitting diode (LED) and a lens array, and form an image of light emitted the from LED on the surface of the photoconductor drums 21K, 21C, 21M, and 21Y.

The transfer unit 4 is disposed below the image forming units 2K, 2C, 2M, and 2Y. The transfer unit 4 has a transfer belt 41 for electrostatically attracting and transporting the paper P, a drive roller 42 and a tension roller 43 over which the transfer belt 41 is extended, and four transfer rollers 40K, 40C, 40M, and 40Y which are disposed as transfer members to be opposed to the photoconductor drums 21K, 21C, 21M, and 21Y of the image forming units 2K, 2C, 2M, and 2Y.

The drive roller 42 is rotationally driven by a paper transport motor 109 (FIG. 3), and the transfer belt 41 is moved in the direction indicated by an arrow C. The tension roller 43 applies a predetermined tension to transfer belt 41.

The transfer belt 41 attracts the paper P on the surface, is moved by the rotation of the drive roller 42, and transports the paper P along the image forming units 2K, 2C, 2M, and 2Y. The transfer belt 41 is made of materials such as polyamide-imide or polyamide, and carbon is added to the materials to obtain conductivity and mechanical strength.

The transfer rollers 40K, 40C, 40M, and 40Y are in pressure contact with the photoconductor drums 21K, 21C, 21M, and 21Y via the transfer belt 41. A transfer voltage for transferring toner images formed on the surfaces of the photoconductor drums 21K, 21C, 21M, and 21Y is applied to the transfer rollers 40K, 40C, 40M, and 40Y.

The fixing unit 7 is disposed on the downstream side (the left side in FIG. 1) of the image forming units 2K, 2C, 2M, and 2Y in the transport direction of the paper P. The fixing unit 7 includes a heating roller 7*a*, a pressure roller 7*b*, and a thermistor 7*c*.

The heating roller 7*a* is a roller such that a heat-resistant elastic layer of silicone rubber is provided around a hollow cylinder-shaped core metal made of aluminum, and the surface of the heat-resistant elastic layer is covered with a tetrafluoroethylene-perfluoroalkyl vinyl ether copolymer (PFA) tube. For instance, a heater such as a halogen lamp is provided inwardly of the core metal of the heating roller 7*a*.

The pressure roller 7*b* is a roller such that a heat-resistant elastic layer of silicone rubber is provided on the surface of the aluminum core metal, and the surface of the heat-resistant elastic layer is covered with a PFA tube. A pressure-contact portion (fixing nip) is formed between the pressure roller 7*b* and the heating roller 7*a*.

Figure 3:
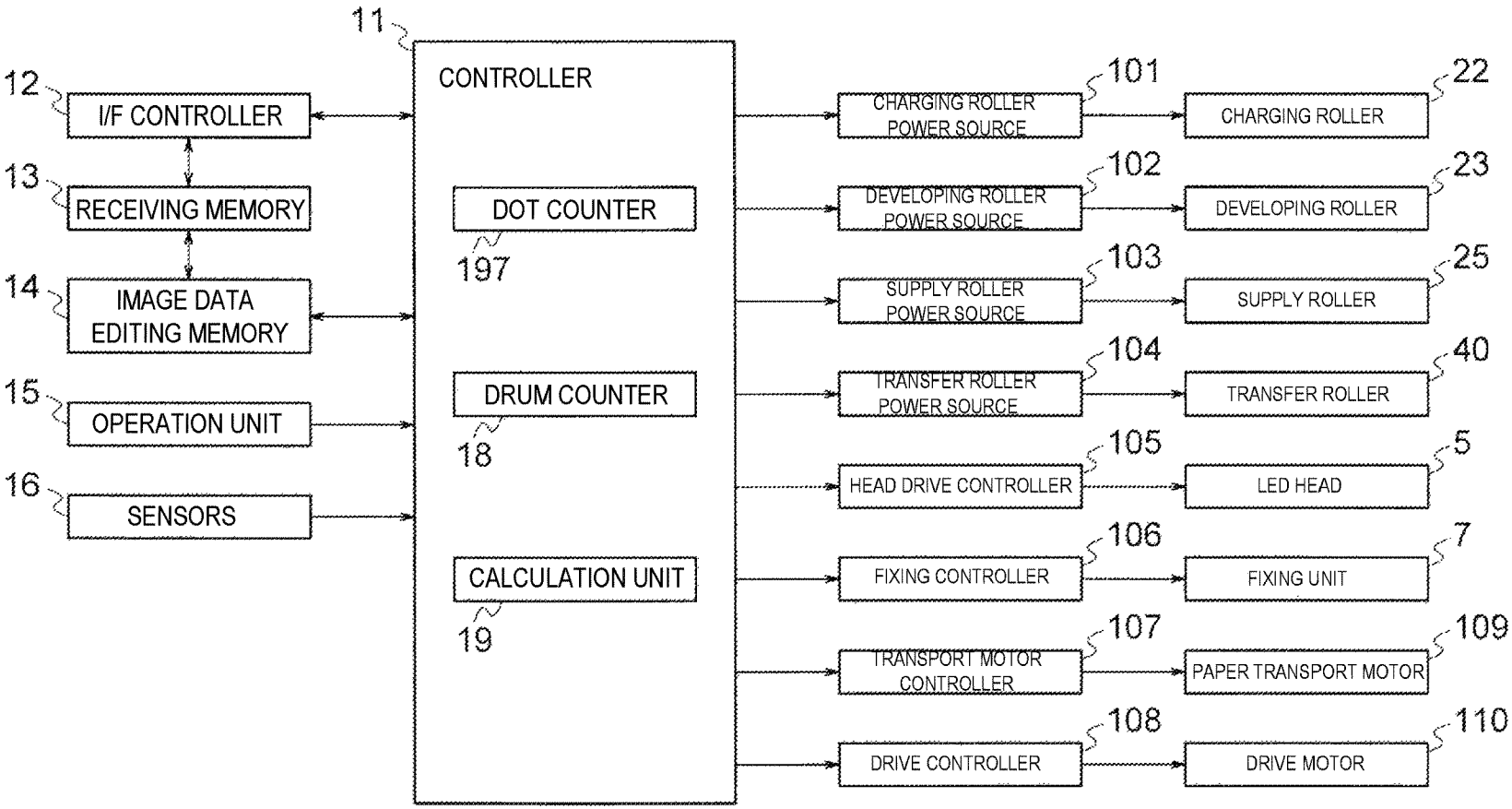
FIG. 3 is a block diagram illustrating the principal unit of a control system of the image forming apparatus.

The thermistor 7*c* is a detection unit for the surface temperature of the heating roller 7*a*, and is disposed in the vicinity of the heating roller 7*a* in a non-contact manner. The temperature information detected by the thermistor 7*c* is outputted to a fixing controller 106 (FIG. 3). The fixing controller 106 controls ON and OFF of the heater in the heating roller 7*a* based on the temperature information of the thermistor 7*c*, and maintains the surface temperature of the heating roller 7*a* at a predetermined temperature.

The discharge roller pair 63 discharges the paper P delivered from the fixing unit 7 to the outside of the image forming apparatus 1, and is driven by the paper transport motor 109 (FIG. 3). The upper cover of the image forming apparatus 1 is provided with a stacker unit for placing the paper P discharged by the discharge roller pair 63.

It is to be noted that the image forming units 2K, 2C, 2M, and 2Y and the toner cartridges 3Y, 3M, 3C, and 3K are replaceable units in the image forming apparatus 1. Thus, when component parts deteriorate, or when toner is consumed, the image forming units 2K, 2C, 2M, and 2Y and the toner cartridges 3Y, 3M, 3C, and 3K can be replaced.

<Control System of Image Forming Apparatus>

Next, the control system of the image forming apparatus 1 will be described. FIG. 3 is a block diagram illustrating the principal unit of the control system of the image forming apparatus 1. As illustrated in FIG. 3, the image forming apparatus 1 has a controller 11, an interface controller 12, a receiving memory 13, an image data editing memory 14, an operation unit 15, and a sensor group 16.

The controller 11 includes a microprocessor, a ROM, a RAM, an input/output port, and a timer. The controller 11 receives print data and control commands from a higher-level device such as a personal computer, and performs a printing operation by controlling the entire sequence of the image forming apparatus 1.

The controller 11 has a dot counter 17, a drum counter 18, and a calculation unit 19. The dot counter 17 counts the number of dots necessary for printing based on the image data of the image data editing memory 14. The drum counter 18 counts the number of rotations of the photoconductor drum 21 which is rotated during a printing operation. The calculation unit 19 performs calculation based on information such as a temperature inputted from the sensor group 16, and the number of rotations counted by the drum counter 18.

The receiving memory 13 temporarily records the print data inputted from a higher-level device via the interface controller 12. The image data editing memory 14 receives the print data recorded on the receiving memory 13, and generates image data (that is, image data) by performing editing processing on the print data, and records the image data.

The operation unit 15 has a display (for instance, an LED) that displays the state of the image forming apparatus 1, and a switch and a display screen for inputting an instruction to the image forming apparatus 1 by an operator. The sensor group 16 includes various sensors for monitoring the operating state of the image forming apparatus 1, for instance, a paper position sensor that detects the position of the paper P, a temperature-and-humidity sensor that detects temperature and humidity around the image forming apparatus 1, and a concentration sensor that detects the concentration of an image.

The image forming apparatus 1 further has a charging roller power source 101, a developing roller power source 102, a supply roller power source 103, a transfer roller power source 104, a head drive controller 105, a fixing controller 106, a transport motor controller 107, a drive controller 108, a paper transport motor 109, and a drive motor 110.

The charging roller power source 101 applies a charging voltage to the charging roller 22, the charging voltage for uniformly charging the surface of the photoconductor drum 21. The developing roller power source 102 applies a developing voltage to the developing roller 23, the developing voltage for causing toner to adhere to an electrostatic latent image of the photoconductor drum 21. The supply roller power source 103 applies a supply voltage to the supply roller 25, the supply voltage for supplying toner to the developing roller 23. The transfer roller power source 104 applies a transfer voltage to the transfer roller 40, the transfer voltage for transferring toner of the photoconductor drum 21 to the paper P.

The charging roller power source 101, the developing roller power source 102, the supply roller power source 103, and the transfer roller power source 104 are singly illustrated in FIG. 3, and are provided in each of the image forming units 2K, 2C, 2M, and 2Y. The voltage of each power supply can be changed by an instruction of the controller 11.

The head drive controller 105 sends the image data recorded on the image data editing memory 14 to an LED head 5, and controls the emission of light of the LED head 5. The head drive controller 105 is singly illustrated in FIG. 3, and is provided in each of the LED heads 5K, 5C, 5M, and 5Y.

The fixing controller 106 applies a voltage to the heater of the heating roller 7*a* of the fixing unit 7 based on the detection temperature of the thermistor 7*c*, and maintains the temperature of the heating roller 7*a* at a predetermined temperature (fixing temperature).

The transport motor controller 107 controls the rotation of the paper transport motor 109 so that the paper P is transported or transportation of the paper P is stopped at predetermined timing by an instruction of the controller 11. The paper transport motor 109 drives the pickup roller 61, the transport roller pair 62, and the discharge roller pair 63.

The drive controller 108 controls the rotation of the drive motor (drum motor) 110 that rotates the photoconductor drum 21. It is to be noted that the rotation of the photoconductor drum 21 is transmitted to the developing roller 23 and the supply roller 25 via a transmission gear. Also, the charging roller 22 and the transfer roller 40 follow the photoconductor drum 21 and rotate.

<Configuration of Supply Roller 25>

Figure 4A:
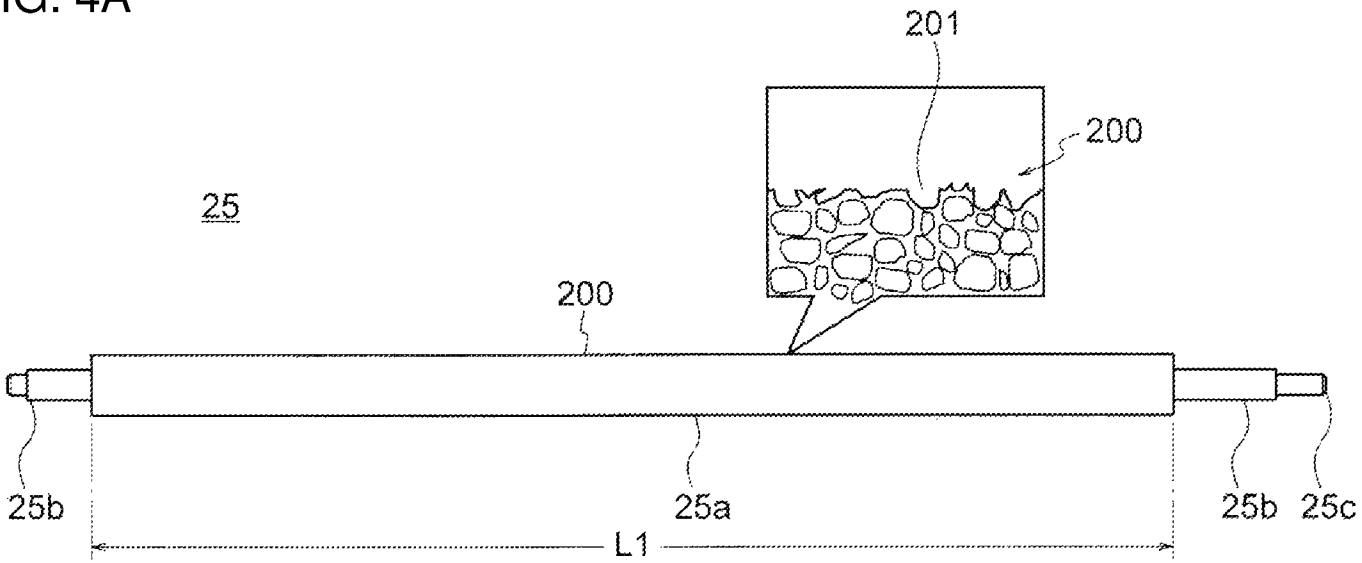
FIGS. 4A and 4B are is a front view and a cross-sectional view illustrating the supply roller in an embodiment.
Figure 4B:
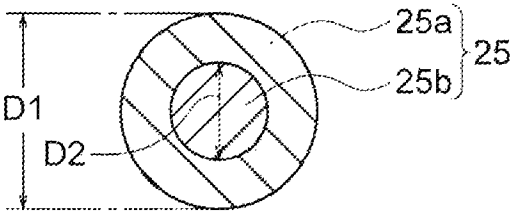

Next, the configuration of the supply roller 25 will be described. FIG. 4 A is a front view illustrating the supply roller 25, and FIG. 4B is a cross-sectional view illustrating the supply roller 25. As mentioned above, the supply roller 25 has the shaft (core metal) 25*b*, and the conductive foam layer 25*a* formed on the surface of the shaft 25*b*. An outer diameter D1 of the conductive foam layer 25*a* is, for instance, 13 mm, and an outer diameter D2 of the shaft 25*b* is, for instance, 6 mm. The length L1 in the axial direction of the conductive foam layer 25*a* is, for instance, 222 mm. Also, an adhesive layer may be formed between the conductive foam layer 25*a* and the shaft 25*b*.

The shaft 25*b* is made of metal having rigidity and conductivity, such as iron, copper, brass, stainless steel, aluminum, or nickel. However, the shaft 25*b* may be made of materials other than metal as long as the materials have rigidity and conductivity. For instance, the shaft 25*b* may be made of a resin molded article or ceramics in which conductive particles are distributed.

The shape of the shaft 25*b* may be an axial shape or a hollow pipe shape. At an end of the shaft 25*b*, a level difference 25*c* for mounting a gear may be formed or a pin hole or the like may be formed. At an end of the shaft 25*b*, a bearing having a diameter smaller the diameter of the central portion (that is, the portion surrounded by the conductive foam layer 25*a*) may be formed.

The outer diameter of the conductive foam layer 25*a* is nearly constant in the axial direction. However, the conductive foam layer 25*a* may have a crown shape or a tapered shape in which the outer diameter is smaller at a position closer to the axial end of the supply roller 25, or a shape in which the diameters at both ends are different.

The conductive foam layer 25*a* has air cells (cells) 201 which are open to the surface 200. The air cells 201 are closed air cells (closed cells) which are not continuous. The sizes of the air cells 201 are 200 to 300 μm, for instance. The Asker F hardness of the conductive foam layer 25*a* is 30 degrees greater than and 50 degrees or less. Also, the stress decay of the conductive foam layer 25*a* is 25% or less, and the residual strain is 100 μm or less.

The rubber material, of which the conductive foam layer 25*a* is made, contains silicone rubber as a main component. The main component indicates a component that accounts for 50% by weight or greater of the entirety. Also, silicone rubber may be denatured silicone rubber.

As an accessory component (component other than the main component), the rubber material, of which the conductive foam layer 25*a* is made, may contain crude rubber, nitrile rubber, ethylene-propylene rubber, ethylene propylene diene rubber (EPDM), styrene butadiene rubber, acrylonitrile-butadiene rubber, butadiene rubber, polyisoprene rubber, acrylic rubber, chloroprene rubber, butyl rubber, epichlorohydrin rubber urethane rubber, fluoro-rubber, or polyether rubber. Also, the rubber material may contain elastomer such as polyurethane, polystyrene, polybutadiene block polymer, polyolefin, polyethylene, chlorinated polyethylene, ethylene-vinyl acetate copolymer. Also, one type or two or more types of these materials may be combined.

Although these rubber materials can be arbitrarily selected from a millable type or a liquid type, a rubber material of a millable type (in other words, a rubber material which has high viscosity and allows roll forming) is desirable.

Figure 5:
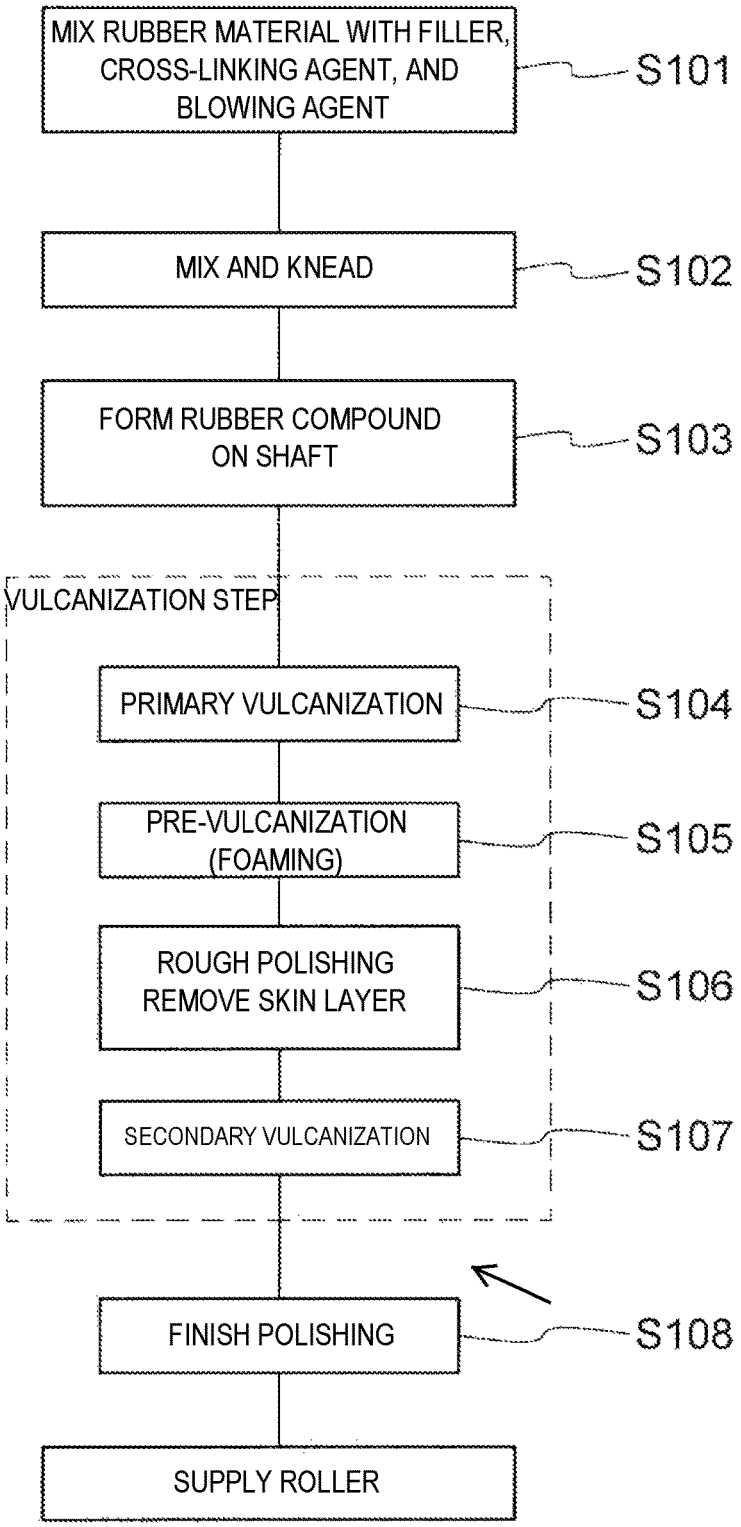
FIG. 5 is a flowchart for explaining the manufacturing process of the supply roller.

Next, the manufacturing process of the supply roller 25 will be described. FIG. 5 is a flowchart illustrating the manufacturing process of the supply roller 25. First, a filler, a blowing agent, and a cross-linking agent are added to the above-described rubber material (step S101).

The filler includes a reinforcing filler and a conductive filler. For instance, silica (fumed silica or precipitated silica), or reinforcing carbon black may be used as the reinforcing filler. For instance, conductive carbon black, powder of metal such as nickel, aluminum, copper, a metal oxide such as zinc oxide, or barium sulfate, titanium oxide, or potassium titanate which is coated with tin oxide may be used as the conductive filler. Here, titanium, reinforcing carbon black, and conductive carbon black are used as the filler.

An azo compound-based blowing agent is used as the foaming agent. However, instead of an azo compound-based blowing agent, bicarbonate-based, isocyanate-based, nitrite salt, hydrazine derivative, or azide compound-based blowing agent may be used.

A peroxide and a sulfur-based vulcanizing agent are used as the cross-linking agent (vulcanizing agent). However, instead of these, hydrogen siloxane in the presence of a platinum catalyst, or an isocyanate agent may be used.

Like this, a rubber material with a filler, a blowing agent, and a cross-linking agent added is mixed, and kneaded using a pressure kneader or a mixing roll (step S102).

The kneaded material (rubber compound) is filled in an extruder, and is extruded to the surrounding of the shaft 25*b* and shaped (step S103). Consequently, a cylindrical rubber compound is shaped on the surface of the shaft 25*b*. Hereinafter, the shaft 25*b* in which the rubber compound is formed on the surface is referred to as the roller body.

Next, thus shaped roller body is set in a heating furnace, and is heated to a temperature (for instance, approximately 150 to 160° C.) necessary for vulcanizing rubber (step S104). In this step (primary vulcanization step), although vulcanization of rubber proceeds, no foam is produced.

Figure 6:
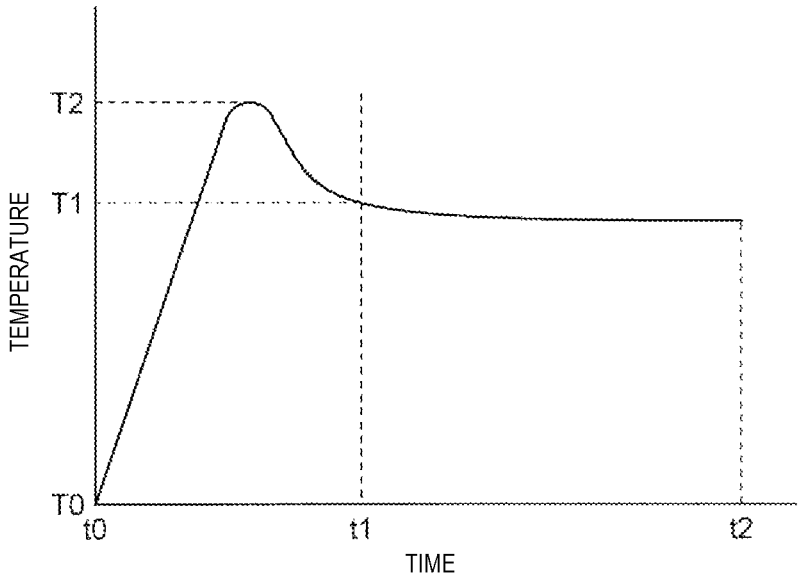
FIG. 6 is a temperature rise curve in a vulcanization step for a conductive foam layer in the manufacturing process of the supply roller.

After the primary vulcanization step, pre-vulcanization step (step S105) for foaming is performed. In the pre-vulcanization step, the roller body is heated at a temperature higher than the temperature in the above-mentioned primary vulcanization step. FIG. 6 is a graph illustrating a temperature rise curve in the pre-vulcanization step and the secondary vulcanization step (described below), the vertical axis indicates temperature, and the horizontal axis indicates time.

The pre-vulcanization step corresponds to the time period t0 to t1 illustrated in FIG. 6. In the pre-vulcanization step, the temperature rises to a temperature T2 which is the peak temperature, then falls to a temperature T1 lower than the temperature T2. The temperatures T1, T2 are each higher than the heating temperature (approximately 150 to 160° C.) in the primary vulcanization step. Thus, foaming occurs, and air cells are formed, thus vulcanization of rubber proceeds.

After the pre-vulcanization step, the roller body is taken out from the heating furnace, and the outer circumference of the foam layer of the roller body is roughly polished (step S106). Here, a range with several millimeters of thickness of the outer circumference (surface) of the foam layer is removed by rough polishing. In the above-described primary vulcanization step and pre-vulcanization step, a skin layer having small air cells is formed on the outer circumference of the foam layer, and the skin layer is removed by rough polishing.

Subsequently, the roughly-polished roller body is set in the heating furnace, and the secondary vulcanization step (step S107) is performed. The secondary vulcanization step corresponds to the time period t1 to t2 illustrated in FIG. 6. In the secondary vulcanization step, the roller body is heated to the temperature T1 mentioned above. Consequently, air cells are further formed, and vulcanization of rubber proceeds. It is to be noted that before time t1, there is practically a temperature rise process after the roller body is set in the heating furnace.

Since a skin layer is removed beforehand in the secondary vulcanization step, unbalance (distortion) of the cross-linking state of the rubber can be reduced, and air cells can be uniformly formed (that is, with a uniform size over the entire surface of the foam layer). Also, in the secondary vulcanization step, low-molecular siloxane derived from silicone is removed by volatilization, and since a skin layer has been removed from the surface of the foam layer as described above, the low-molecular siloxane can be effectively removed.

After the secondary vulcanization step, finish machining is performed on the surface of the foam layer of the roller body, and a predetermined outer diameter is obtained (step S108). Consequently, the supply roller 25 is formed, in which the conductive foam layer 25*a* is formed on the surface of the shaft 25*b*.

<Functional Effect>

Next, the functional effect of the supply roller 25 will be described. As described above, the conductive foam layer 25*a* of the supply roller 25 contains silicone rubber as a main component. A general conductive foam layer containing urethane rubber as a main component has continuous air cells (in other words, the air cells are connected). In contrast, the conductive foam layer 25*a* containing silicone rubber as a main component has closed cells (in other words, the air cells are independent from each other).

In the case of a conductive foam layer having continuous air cells, toner can enter deep inside the air cells, and thus the toner may get clogged in the air cells. Therefore, as the number of sheets printed by the image forming apparatus 1 increases, the amount of toner clogged in the air cells increases, and as a result, the hardness and the electric resistance of the conductive foam layer increase, and image unevenness (blur) due to insufficient toner supply occurs.

In contrast, in the case of a conductive foam layer having closed air cells, toner does not enter deep inside the air cells, and thus clogging of toner in the air cells is unlikely to occur. Therefore, even when the number of sheets printed by the image forming apparatus 1 increases, the hardness and the electric resistance of the conductive foam layer has a low increase, and the occurrence of image unevenness (blur) is also suppressed.

Also, the stress decay of the conductive foam layer 25*a* of the supply roller 25 is 25% or less, and the residual strain is 100 μm or less. The conductive foam layer 25*a* has a configuration in which permanent strain is unlikely to occur.

Therefore, even when the conductive foam layer 25*a* of the supply roller 25 is left unoperated for a long period of time with depressed by the developing roller 23, and a depressed area is formed at the depressed portion, if a pressing pressure is released, the shape of the conductive foam layer 25*a* is likely to be restored. Therefore, even when printing is performed after a long period of time of non-operation, insufficient toner supply is unlikely to occur, and the occurrence of image unevenness can be suppressed.

Also, the conductive foam layer 25*a* containing silicone rubber as main component has a longer life than a general conductive foam layer containing urethane rubber as a main component. Therefore, the supply roller 25 needs to be replaced with a less frequency.

Also, as described above, in the vulcanization step of the supply roller 25, the conductive foam layer 25*a* is caused to foam in the pre-vulcanization step, and a skin layer on the surface is removed, and the secondary vulcanization steps is performed anew. Thus, air cells can be uniformly formed.

Also, in the secondary vulcanization step, removal of the low-molecular siloxane by volatilization is not prevented by a skin layer, and thus the low-molecular siloxane can be effectively removed.

<Operation of Image Forming Apparatus>

Next, the operation of the image forming apparatus 1 will be described with reference to FIGS. 1 and 3. The image forming units 2K, 2C, 2M, and 2Y of the image forming apparatus 1 receive supply of black, cyan, magenta, and yellow toner from the toner cartridges 3K, 3C, 3M, and 3Y, and are in a printable state.

When the controller 11 of the image forming apparatus 1 receives print data and control commands from a higher-level device such as a personal computer via the interface controller 12, the controller 11 starts a printing operation (image forming operation).

The transport motor controller 107 drives the paper transport motor 109 by an instruction of the controller 11, and the paper P in the paper feed cassette 60 is delivered in the direction indicated by the arrow A by the pickup roller 61. Furthermore, the paper P is delivered in the direction indicated by the arrow B by the transport roller pair 62. Also, the drive roller 42 rotates, and moves the transfer belt 41 in the direction indicated by the arrow C.

The transfer belt 41 attracts, holds and transports the paper P so that the paper P is passed through the image forming units 2K, 2C, 2M, and 2Y.

Also, the drive controller 108 drives the drive motor 110 by an instruction of the controller 11, and rotates the photoconductor drums 21K, 21C, 21M, and 21Y. The rotation of the drive motor 110 is also transmitted to the developing rollers 23K, 23C, 23M, and 23Y and the supply rollers 25K, 25C, 25M, and 25Y, and the developing rollers 23K, 23C, 23M, and 23Y and the supply rollers 25K, 25C, 25M, and 25Y are also rotated.

In the image forming units 2K, 2C, 2M, and 2Y, the charging rollers 22K, 22C, 22M, and 22Y each receive application of a charging voltage (a bias voltage having the same polarity as that of toner) by the charging roller power source 101, and uniformly charge the surface of each of the photoconductor drums 21K, 21C, 21M, and 21Y.

The LED heads 5K, 5C, 5M, and 5Y are driven by the head drive controller 105, and expose the surfaces of the photoconductor drums 21K, 21C, 21M, and 21Y to light based on the image data of each color, and form an electrostatic latent image.

The developing rollers 23K, 23C, 23M, and 23Y each receive application of a developing voltage (a bias voltage having the same polarity as or the reverse polarity to that of toner) by the developing roller power source 102, and charge the toner adhering to the surfaces.

The developing blades 24K, 24C, 24M, and 24Y are pressed against the developing rollers 23K, 23C, 23M, and 23Y, and regulate the thickness of each toner layer on the surfaces of the developing rollers 23K, 23C, 23M, and 23Y. It is to be noted that a bias voltage (blade voltage) may be applied to the developing blades 24K, 24C, 24M, and 24Y by the developing roller power source 102 or the supply roller power source 103.

The supply rollers 25K, 25C, 25M, and 25Y each receive application of a supply voltage (a bias voltage having the same polarity as or the reverse polarity to that of toner) by the supply roller power source 103, and supply the toner supplied from the toner cartridges 3K, 3M, 3Y, and 3C to the developing rollers 23K, 23C, 23M, and 23Y.

Furthermore, the supply rollers 25K, 25C, 25M, and 25Y have a function of charging toner by contact friction with the developing rollers 23K, 23C, 23M, and 23Y as well as a function of collecting the toner not used for development from the developing rollers 23K, 23C, 23M, and 23Y.

The cleaning blades 26K, 26C, 26M, and 26Y scrape off and remove the residual toner remaining on the surfaces of the photoconductor drums 21K, 21C, 21M, and 21Y. The cleaning blades 26K, 26C, 26M, and 26Y also scrape off and remove adhering materials which have adhered to the surface of photoconductor drums 21K, 21C, 21M, and 21Y from the transfer belt 41 although the amount of adhering materials is very small in quantity.

The transport members 27K, 27C, 27M, and 27Y transport the toner (waste toner) and the adhering materials scraped off from the photoconductor drums 21K, 21C, 21M, and 21Y by the cleaning blades 26K, 26C, 26M, and 26Y.

The transfer rollers 40K, 40C, 40M, and 40Y of the transfer unit 4 each receive application of a transfer voltage (a bias voltage the reverse polarity to that of toner) by the transfer roller power source 104, and transfer a toner image of each color from the photoconductor drums 21K, 21C, 21M, and 21Y to the paper P.

The paper P, to which a toner image of each color has been transferred in this manner, is further transported by the transfer belt 41, and arrives at the fixing unit 7. In the fixing unit 7, the fixing controller 106 controls the heater of the heating roller 7*a* based on the surface temperature of the heating roller 7*a* detected by the thermistor 7*c*, and maintains the surface temperature of the heating roller 7*a* at a predetermined temperature. The paper P with a toner image transferred is passed through the pressure-contact portion (fixing nip) between the heating roller 7*a* and the pressure roller 7*b*, and heat and pressure are thereby applied onto the toner image which is fixed to the paper P.

The paper P with the toner image fixed is transported by the discharge roller pair 63 which is rotated by the paper transport motor 109, and is discharged to the outside of the image forming apparatus 1.

<Print Test>

Next, a print test for verifying the functional effect of the supply roller 25 will be described. First, in the manufacturing process illustrated in FIG. 5, the time t1 and the temperature T1 (FIG. 6) in the pre-vulcanization step are made different, and thus the supply rollers 25 in Examples 1, 2, 3 and Comparative Examples 1, 2, 3 are produced with different stress decays and residual strains.

In Examples 1, 2, 3 and Comparative Examples 1, 2, silicone rubber is used as the rubber material, and in Comparative Example 3, urethane rubber is used as the rubber material. In each of Examples 1 to 3 and Comparative Examples 1 to 3, cyan, reinforcing carbon black, and conductive carbon black are used as the filler, and an azo compound-based blowing agent is used as the foaming agent, and a peroxide and a sulfur-based vulcanizing agent are used as the cross-linking agent.

Figure 7:
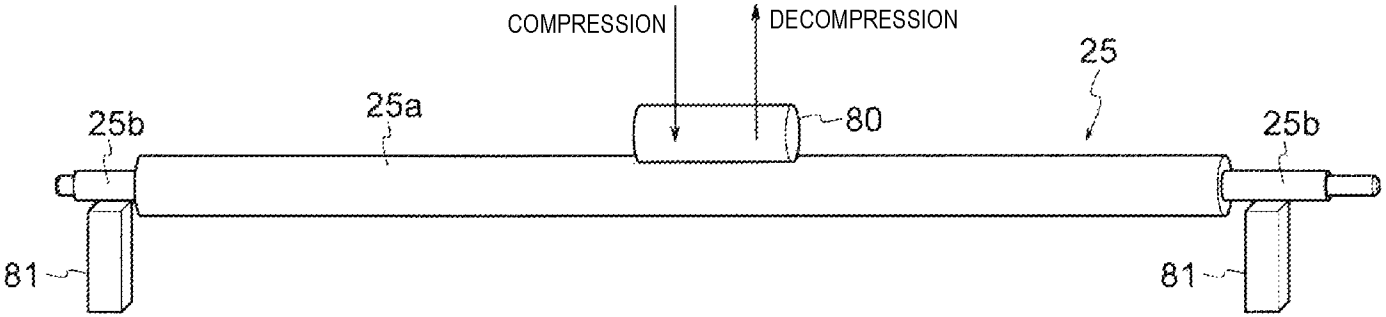
FIG. 7 is a schematic illustration for explaining a method of measuring stress decay and residual strain of the supply roller.
Figure 8:
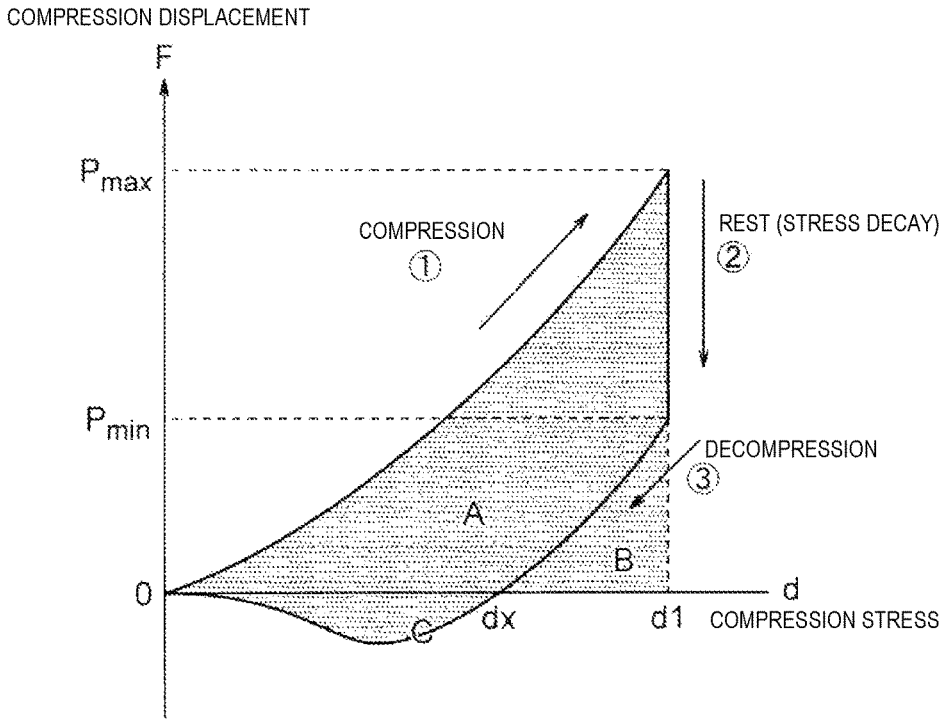
FIG. 8 is a graph illustrating the hysteresis loop in measurement of FIG. 7.

FIG. 7 is a schematic illustration depicting a method of measuring hysteresis characteristics for determining stress decay and residual strain. FIG. 8 is a graph illustrating a hysteresis loop (stress-strain curve). To measure hysteresis characteristics, mechanical displacement meter "5543A" manufactured by Intron corporation is used. As illustrated in FIG. 7, in the mechanical displacement meter, both ends of the shaft 25*b* of the supply roller 25 having an outer diameter of 13 mm are supported by a pair of supports 81. A cylindrical gauge head 80 having a length of 50 mm and an outer diameter of 16 mm is pressed against the axial center of the outer circumferential surface of the conductive foam layer 25*a* of the supply roller 25.

In this state, the supply roller 25 is pressed by the gauge head 80 (compression step 1 illustrated in FIG. 8) so that a displacement amount (d1) is 1 mm at a displacement speed of 10 mm/min. In this state, the gauge head 80 remains at rest for 1 hour (stress decay step 2 illustrated in FIG. 8). Subsequently, the gauge head 80 is returned to the original position at a displacement speed of 10 mm/min (decompression step 3 illustrated in FIG. 8). The stress decay and the residual strain can be determined from the hysteresis loop illustrated in FIG. 8.

Specifically, in the hysteresis loop of FIG. 8, let Pmax be the maximum stress at the completion time of the compression step 1, Pmin be the stress (stress at the time of decay) at the completion time of the stress decay step 2, and dx be the displacement amount when the compression stress is 0 in the decompression step 3. The stress decay can be determined by (Pmax−Pmin)/Pmax×100(%). Also, the residual strain, that is, the displacement amount at the time of release of stress is dx (μm).

The hysteresis loop of FIG. 8 is produced for each of all supply rollers 25 in Examples 1 to 3 and Comparative Examples 1 to 3, and the stress decay and the residual strain of the conductive foam layer 25*a* are measured. The result is illustrated in Table 1.

TABLE 1

| Supply Roller | Stress Decay (%) | Residual Strain (μm) | Air Cell state | Asker F Hardness | Presence of Horizontal White Strip | Others |
|---|---|---|---|---|---|---|
| Comparative Example 1 | 37 | 235 | Closed Cells | 50 | Present | — |
| Comparative Example 2 | 30 | 131 | Closed Cells | 55 | Partially Present | — |
| Comparative Example 3 | 24 | 94 | Continuous Cells | 30 | Absent | Image Blur |
| Example 1 | 23 | 98 | Closed Cells | 30 | Absent | — |
| Example 2 | 20 | 87 | Closed Cells | 40 | Absent | — |
| Example 3 | 18 | 81 | Closed Cells | 50 | Absent | — |

Table 1 further illustrates an air cell state (continuous cells or closed cells) and the Asker F hardness of the conductive foam layer 25*a* for each of the supply rollers 25 in Examples 1 to 3 and Comparative Examples 1 to 3.

Next, each of the supply rollers 25 in Examples 1 to 3 and Comparative Examples 1 to 3 is mounted in an image forming unit 2C of the image forming apparatus 1 (FIG. 1), and is left for one month in contact with the developing roller 23 in an environment with a temperature of 47° C. and a relative humidity of 66%. After each supply roller 25 is left for one month, a print test is conducted by the image forming apparatus 1.

"Color LED printer C542dnw" manufactured by OKI data Co., Ltd. is used as the image forming apparatus 1, and only the image forming unit 2C for cyan is mounted out of four image forming units 2K, 2C, 2M, and 2Y. "Xerox 4200 LT 20Ib New92" (letter size) manufactured by Fuji Xerox Co., Ltd. is used as the paper P.

As a print pattern, a solid pattern (solid image) of cyan with a print duty of 100% is used. Intermittent printing of one page is performed with single-sided printing. Also, the number of printed sheets is three, and the last sheet is visually observed.

Figure 9:
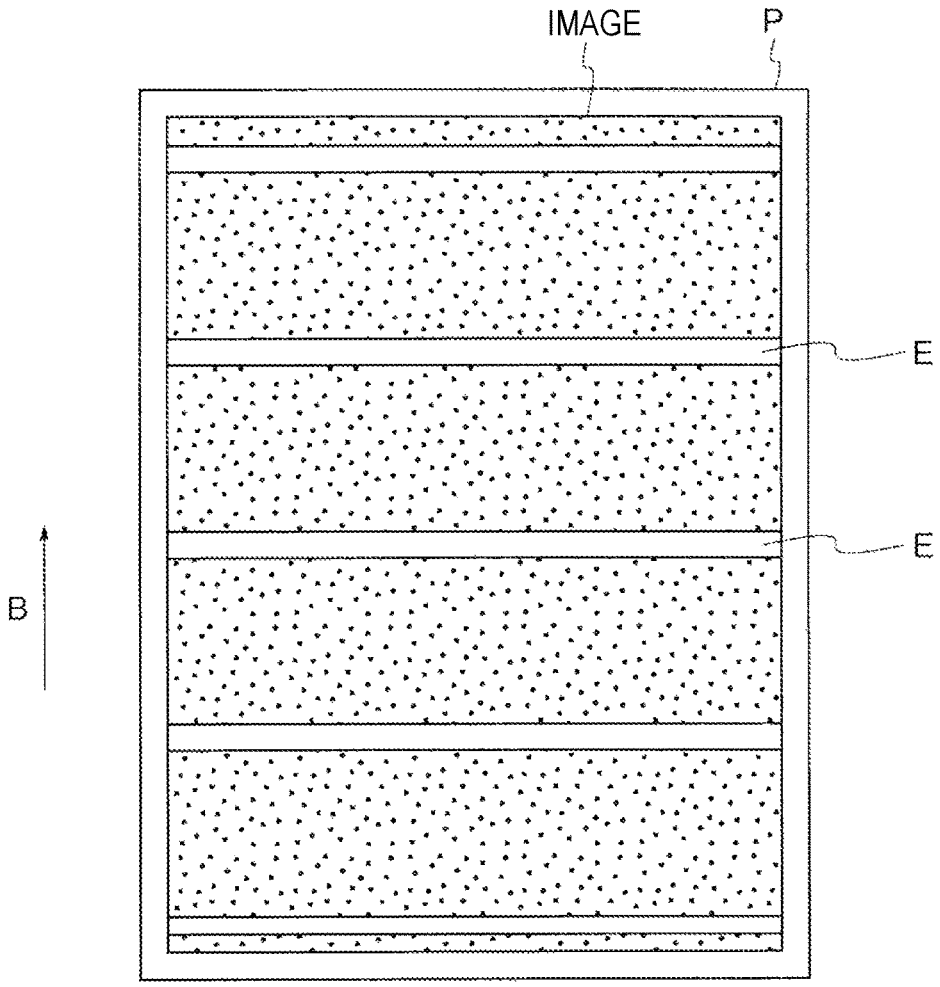
FIG. 9 is a schematic illustration depicting an example of image unevenness.

FIG. 9 is a schematic illustration depicting an example of image unevenness which occurs in the print pattern. The direction indicated by the arrow B in FIG. 9 is the transport direction of the paper P. When a typical supply roller is left in contact with the developing roller for a long period of time, and subsequently, printing is performed, toner supply is insufficient at a depressed area formed in the conductive foam layer of the supply roller, and thus white strips of uneven image (that is, horizontal white strips) occur as indicated by symbol E in FIG. 9. The horizontal white strips extend with a width of several mm in the axial direction of the photoconductor drum (in other words, in the axial direction of the developing roller).

The pattern printed with image forming device 1 incorporating A pattern printed by the image forming apparatus 1 which is incorporated with any supply roller 25 in Comparative Examples 1 to 3 and Examples 1 to 3 is visually observed, and the presence of a horizontal white strip is determined. The result of determination of the presence of a horizontal white strip is presented in the table 1 above.

As illustrated in Table 1, in Comparative Examples 1, 2 in which the stress decay is 30% or greater and the residual strain is 100 μm or greater in the conductive foam layer 25*a*, occurrence of a horizontal white strip is observed. Also, in Comparative Example 3 in which urethane rubber is the main component of the conductive foam layer 25*a*, the stress decay is 24%, and the residual strain is 94 μm (that is, the characteristics in which permanent strain is unlikely to occur), and occurrence of a horizontal white strip is not observed. However, occurrence of image blur is observed in a printed image.

In contrast, in Examples 1, 2, 3 in which silicone rubber is the main component of the conductive foam layer 25*a*, the stress decay is 25% or less (specifically, 23%, 20%, 18%, respectively), and the residual strain is 100 μm or less (specifically, 98 μm, 87 μm, 81 μm, respectively), occurrence of a horizontal white strip is not observed. Also occurrence of image blur is not observed.

This is probably because when the stress decay is 25% or less and the residual strain is 100 μm or less in the conductive foam layer 25*a*, even when the conductive foam layer 25*a* is left for a long period of time with depressed by the developing roller 23, permanent strain is unlikely to occur (in other words, a depressed area formed in the conductive foam layer 25*a* is likely to be restored to the original shape), and therefore, occurrence of a horizontal white strip is suppressed.

Also, when the main component of the conductive foam layer 25*a* is urethane rubber, continuous air cells are formed, and thus toner is likely to get clogged in the continuous air cells. As the number of printed sheets increases, the hardness and the electric resistance of the conductive foam layer 25*a* increase, and image blur is caused. In contrast, when the main component of the conductive foam layer 25*a* is silicone rubber, closed air cells are formed, and thus toner is unlikely to get clogged, and as a result, occurrence of image blur is probably suppressed.

Also, each conductive foam layer 25*a* in Examples 1 to 3 has the Asker F hardness of 30 or greater and 50 or less. Since each conductive foam layer 25*a* in Examples 1 to 3 is relatively flexible like this, a depressed area formed in the conductive foam layer 25*a* is likely to be restored to the original shape, and as a result, an image unevenness suppression effect is probably enhanced.

<Effect>

As described above, according to an embodiment, the supply roller 25 (developer supply member) has the conductive foam layer 25*a* containing silicone rubber as a main component, the stress decay is 25% or less and the residual strain is 100 μm or less in the conductive foam layer 25*a*, even when printing is performed after the conductive foam layer 25*a* is left unoperated for a long period of time with depressed by the developing roller 23, occurrence of image unevenness can be suppressed. Also, since closed air cells are formed, toner is unlikely to get clogged, and occurrence of image blur can be suppressed. Consequently, image quality can be improved.

Also, the conductive foam layer 25*a* containing silicone rubber as a main component has a longer life than any conductive foam layer containing urethane rubber as a main component. Therefore, the supply roller 25 needs to be replaced with a less frequency.

Also, since the supply roller 25 has no skin layer (which is removed in a rough polishing process), unbalance (distortion) of the cross-linking state of the rubber can be reduced, and air cells can be uniformly formed. Also, removal of the low-molecular siloxane by volatilization is not prevented by a skin layer, and thus the low-molecular siloxane can be effectively removed.

Modification

Figure 10:
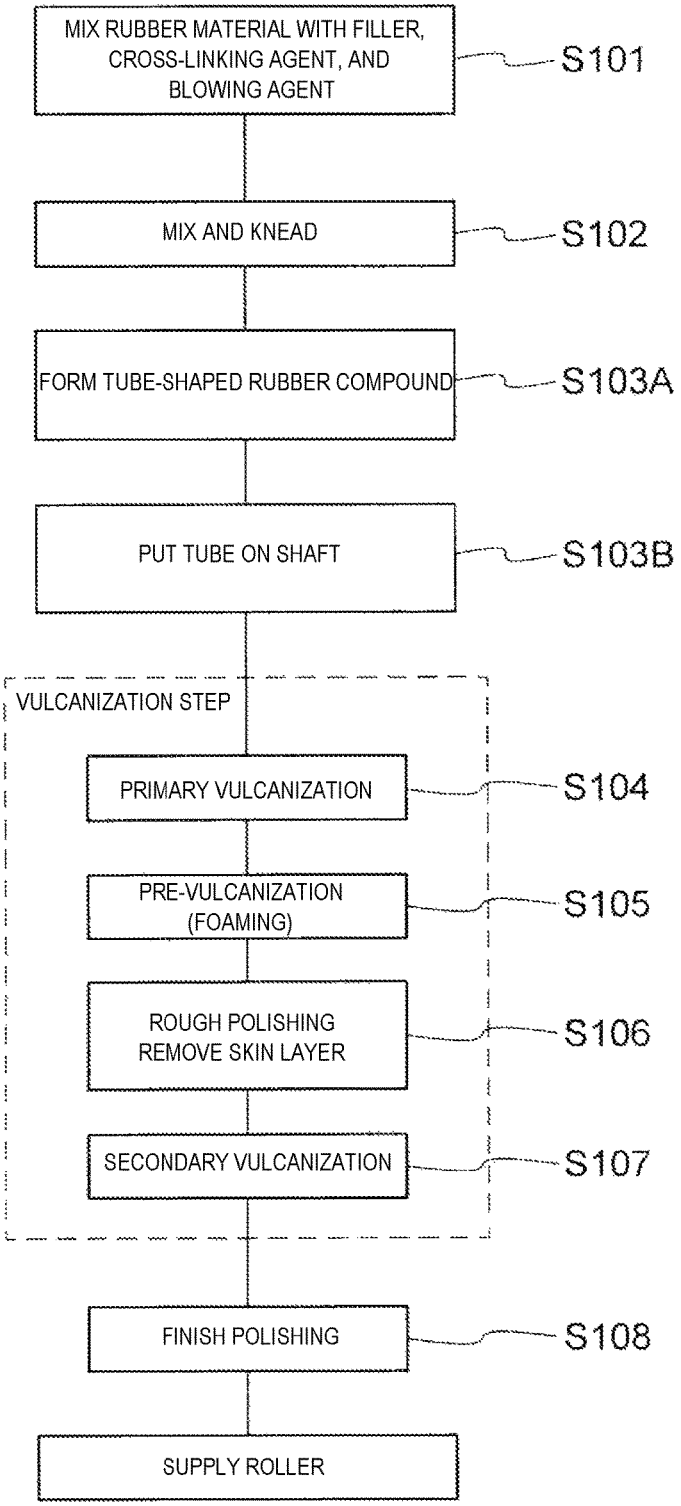
FIG. 10 is a flowchart illustrating a modification of the manufacturing process of the supply roller.

FIG. 10 is a flowchart illustrating a modification of the manufacturing process of the supply roller 25. In the manufacturing process illustrated in FIG. 5, after a rubber compound is shaped on the shaft 25*b* (step S103), the primary vulcanization step (step S104) is performed. However, as illustrated in FIG. 10, a rubber compound may be molded into a tube shape by an extruder (step S103A), and after the tube is put on the shaft 25*b* (step S103B), the primary vulcanization step (step S104) may be performed. Other steps S101, 102, 104 to 108 are as described with reference to FIG. 5.

Although a printer using the electrophotography has been described in an embodiment, the present invention is not limited to this, and is applicable to, for instance, a facsimile, a copying machine, a multi-function peripheral (MFT) using the electrophotography.

Although a preferable embodiment of the present invention has been specifically described above, the present invention is not limited to the embodiment, and various improvements and modifications may be made in a range not departing from the essence of the present invention. The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. A developer supply member comprising:

a shaft with conductivity; and a conductive foam layer that is formed on a surface of the shaft and that contains silicone rubber as a main component, and includes a stress decay of 25% or less and a residual strain of 100 μm or less.

2. The developer supply member according to claim 1, wherein Asker F hardness of the conductive foam layer is 30 degrees or greater and 50 degrees or less.

3. The developer supply member according to claim 1, wherein the conductive foam layer includes closed air cells.

4. The developer supply member according to claim 3, wherein the air cells contain air cells with a diameter of 200 to 300 μm.

5. The developer supply member according to claim 1, wherein the conductive foam layer further contains a filler, a cross-linking agent, and a blowing agent.

6. The developer supply member according to claim 1, wherein in the conductive foam layer, the silicone rubber accounts for 50% by weight or greater of a rubber component contained in the conductive foam layer.

7. An image forming unit comprising:

a developer carrier that supplies a developer to a latent image formed on an image carrier to form a developer image on the image carrier; and the developer supply member according to claim 1 that is disposed in contact with the developer carrier.

8. The image forming unit according to claim 7, wherein the developer supply member is rotated in such a direction that movement directions of surfaces in contact with each other of the developer supply member and the developer carrier are opposite to each other.

9. An image forming unit comprising:

an image carrier that carries a latent image thereon;

a developer carrier that supplies a developer to the latent image on the image carrier to form a developer image; and the developer supply member according to claim 1 that is disposed in contact with the developer carrier and that supplies the developer to the developer carrier.

10. An image forming apparatus comprising:

the image forming unit according to claim 9;

a transfer unit that transfers the developer image from the image carrier onto a medium; and a fixing unit that fixes the developer image to the medium.

11. A developer supply member comprising:

a shaft with conductivity; and a conductive foam layer formed on a surface of the shaft, wherein the conductive foam layer is formed by performing a primary vulcanization, pre-vulcanization, surface polishing and a secondary vulcanization on a rubber compound which contains silicone rubber as a main component and to which a blowing agent and a vulcanizing agent are added.

12. The developer supply member according to claim 11, wherein a surface skin layer of the conductive foam layer is removed by the surface polishing.

13. The developer supply member according to claim 11, wherein a temperature of the pre-vulcanization is higher than a temperature of the primary vulcanization.

14. An image forming unit comprising:

a developer carrier that supplies a developer to a latent image on an image carrier to form a developer image on the image carrier; and the developer supply member according to claim 11 that is disposed in contact with the developer carrier and that supplies the developer to the developer carrier.

15. The image forming unit according to claim 14, wherein the developer supply member is rotated in such a direction that movement directions of surfaces in contact with each other of the developer supply member and the developer carrier are opposite to each other.

16. An image forming unit comprising:

an image carrier that carries a latent image thereon;

a developer carrier that supplies a developer to the latent image on the image carrier to form a developer image; and the developer supply member according to claim 11 that is disposed in contact with the developer carrier and that supplies the developer to the developer carrier.

17. An image forming apparatus comprising:

the image forming unit according to claim 16;

a transfer unit that transfers the developer image from the image carrier onto a medium; and a fixing unit that fixes the developer image to the medium.

* * * * *